United States Patent [19]

Carter et al.

[11] 4,441,975

[45] Apr. 10, 1984

[54] ELECTROTREATING APPARATUS WITH ELECTRODE ROLL

[75] Inventors: William A. Carter, Munster; Frank A. Martin, Merrillville, both of Ind.

[73] Assignee: Inland Steel Company, Chicago, Ill.

[21] Appl. No.: 467,360

[22] Filed: Feb. 17, 1983

[51] Int. Cl.[3] ..... C25D 17/00; C25D 17/12

[52] U.S. Cl. ..... 204/206; 204/224 R

[58] Field of Search ..... 204/206, 224 R, 284, 204/290 R

[56] References Cited

U.S. PATENT DOCUMENTS

| | | | |
|---|---|---|---|
| 2,080,234 | 5/1937 | Schlotter | 204/5 |
| 2,961,395 | 11/1960 | Icxi | 204/224 R |
| 3,008,892 | 11/1961 | Owen | 204/207 |
| 3,048,528 | 8/1962 | Covington | 204/141 |
| 3,374,159 | 3/1968 | Poole | 204/206 |
| 3,619,383 | 11/1971 | Eisner | 204/35 R |
| 3,619,384 | 11/1971 | Eisner | 204/35 R |
| 4,082,632 | 4/1978 | Whittle | 204/206 |

*Primary Examiner*—T. M. Tufariello

*Attorney, Agent, or Firm*—Merriam, Marshall & Bicknell

[57] ABSTRACT

An apparatus for electrotreating a metal strip and employing an electrode roll having a metallic outer surface covered by a porous mesh layer composed of electrically non-conductive material and fixedly secured to the outer surface of the electrode roll.

7 Claims, 7 Drawing Figures

ELECTROTREATING APPARATUS WITH ELECTRODE ROLL

BACKGROUND OF THE INVENTION

The present invention relates generally to apparatus for electrotreating a metal strip and more particularly to an electrode roll for such apparatus.

An example of electrotreating is the electrolytic plating of a surface of a metal strip, e.g., electrolytic galvanizing wherein a steel strip is plated with zinc. Other examples of electrotreating include the electrolytic cleaning or pickling of a surface of the metal strip. In all these examples the metal strip is electrically charged and constitutes one electrode in an electrolytic cell having another electrode, with electrolytic liquid between the two electrodes. An electric current flows through the electrolytic liquid between the metal strip and the other electrode, and, depending upon whether the metal strip is to be plated or cleaned, ions flow to or from a strip surface to be either deposited thereon or removed therefrom.

For example, in an electrogalvanizing operation, the metal strip is provided with a negative charge, so as to be a cathode, a metallic anode is placed adjacent the metal strip surface to be coated, and the electrolytic liquid contains zinc ions. The anode may be depletable, in which case it is composed of zinc.

It is often desirable to coat only one surface of the metal strip with zinc, and in such a case, a zinc anode is placed alongside only that surface of the metal strip which is to be coated.

A recently developed electroplating process employs a series of horizontally disposed, cylindrical rolls, each having an outer surface composed of electrically conductive material. Alternating rolls in this series are electrode rolls while the other rolls in the series are contact rolls for electrically charging the metal strip. Each roll is located totally above a bath of electrolytic liquid, and no roll is in contact with the bath. A continuous metal strip having opposed flat surfaces is wrapped sequentially around a substantial portion of each roll in the series, over and under alternate rolls. One surface of the strip touches each contact roll, and the other strip surface is in closely spaced relation to the conductive, outer surface of each electrode roll. The metal strip is advanced in a downstream direction, and the rolls are simultaneously rotated while maintaining the wrapped-around relationship between the strip and each roll.

The outer surface of each electrode roll is charged with a charge having a predetermined polarity, and the contact rolls are charged with an opposite polarity. The metal strip is charged with a polarity opposite to that of the electrode rolls as a result of the strip's contact with the contact rolls. An electrolytic liquid is introduced onto the outer surface of the electrode roll at a location at or in advance of the location where the metal strip joins the electrode roll. The electrolytic liquid is maintained in the space between (a) the electrode roll's outer surface and (b) the adjacent surface of the wrapped-around portion of the metal strip by surrounding the outer surface of each electrode roll with a concentric layer of porous mesh composed of electrically non-conductive material which prevents direct electrical contact between the adjacent strip surface and the electrode roll's outer surface. The mesh layer is typically composed of intersecting strands.

As the metal strip advances in a downstream direction, that surface of the wrapped-around portion of the metal strip adjacent an electrode roll is electrotreated at that electrode roll.

The metal strip may be wrapped around the lower portion of the electrode roll, in which case the top surface of the strip would be the adjacent surface and would undergo electrotreating; or the strip may be wrapped around the upper portion of the electrode roll, in which case the bottom surface of the strip would be the adjacent surface thereof and would undergo electrotreating. A given apparatus may employ a multiplicity of electrode rolls at some of which the top surface of the strip undergoes electrotreating and at others of which the bottom surface of the strip undergoes electrotreating.

The electroplating apparatus described above is disclosed in more detail in the prior filed, commonly-owned U.S. application Ser. No. 424,858 filed Sept. 27, 1982, entitled "Method and Apparatus for Electro-Treating a Metal Strip," William A. Carter, inventor; and the disclosure thereof is incorporated herein by reference.

In an electroplating operation, generally, and in an electrogalvanizing operation particularly, it is desirable that the anode roll be depletable, e.g., composed of zinc when used in an electrogalvanizing operation. The advantages of a depletable anode roll, generally, and of a depletable zinc anode roll in an electrogalvanizing operation, particularly, are described in the aforementioned prior filed, commonly-owned U.S. application.

In the apparatus described in the aforementioned prior filed, commonly-owned U.S. application, the layer of porous mesh material is removably secured to the outside of the depletable anode roll, as by straps surrounding the mesh layer adjacent opposite ends of the anode roll; but this has certain drawbacks. The non-conductive nature of the porous mesh material retards the depletion of cations from those parts of the outer surface of the depletable anode roll covered by the strands of the porous mesh layer. As a result, craters are formed on those parts of the outer surface of the anode roll not covered by the mesh strands, while those parts of the outer surface covered by the mesh strands define ridges around the crater.

In addition to being non-conductive, the porous mesh material is also somewhat elastic, and, in the course of the movement of the metal strip around the rotating mesh-covered anode roll, the strands of elastic mesh material are stretched in both axial and circumferential directions relative to the outside of the anode roll. As a result, the ridges around the craters may become somewhat eroded, but at a substantially slower rate than the craters. When the ridges erode, the layer of removably secured mesh material becomes loosely fitting around the anode roll; and this is undesirable as it can lead to premature mutilation of the layer of porous mesh material requiring its frequent replacement.

The aforementioned prior filed, commonly-owned U.S. application discloses an arrangement for preventing the covering layer of mesh material from becoming too loose as a result of the depletion of the anode roll. In this arrangement, the outer layer of mesh material is rolled up around the anode roll, like a window shade, as the anode roll undergoes depletion. The layer of mesh material has one free end, unsecured to the anode roll or to the remainder of the mesh layer, and straps are employed to prevent this free end from flapping. The drawback to this arrangement is its relative complexity.

Premature mutilation of the layer of mesh material can also occur as a result of the stretching or shifting movement of the mesh strands in axial or circumferential directions relative to the crater ridges.

More particularly, as the metal strip moves around the rotating anode roll, the strip exerts pressure against each mesh strand. When a mesh strand is fully-supported from below by a crater ridge, it is better able to withstand the pressure exerted against it by the metal strip than when the strand is shifted to a position in which it partially overlaps the underlying crater ridge. In the latter case, the mesh strand is not fully supported by an underlying crater ridge and is less able to withstand the pressure of the metal strip, leading to premature mutilation of the mesh layer.

SUMMARY OF THE INVENTION

In accordance with the present invention, loosening and premature mutilation of the layer of mesh material is prevented by fixedly securing the mesh layer to the outer surface of the electrode roll, either with adhesive or by integrally bonding the layer of mesh material to the outer surface of the anode roll. As a result, the outside diameter of the anode roll is maintained at its initial value substantially throughout the electrotreating operation, the layer of porous mesh material covering the anode roll is not loosened; and the fit remains tight.

Moreover, because the mesh layer is fixedly secured to the outer surface of the electrode roll, the mesh strands do not undergo shifting or movement, in either axial or circumferential directions on the anode roll, relative to the crater ridges to which these strands are secured. This prevents the mesh layer from undergoing the premature mutilation which occurs when there is movement of the type described in the preceding sentence.

In one embodiment of the present invention, in which the porous mesh layer is integrally bonded to the outer surface of the electrode roll, the porous mesh layer comprises a multiplicity of alternate spiral ridges and grooves, rather than intersecting strands.

Although the present invention is most usefully employed in connection with a depletable anode roll, it may also be employed in connection with non-depletable rolls in which the outer surface of the anode roll is composed of lead or graphite, for example, rather than zinc, in an electrogalvanizing operation.

Other features and advantages are inherent in the apparatus claimed and disclosed or will become apparent to those skilled in the art from the following detailed description in conjunction with the accompanying diagrammatic drawings. dr

DETAILED DESCRIPTION

Figure 1:
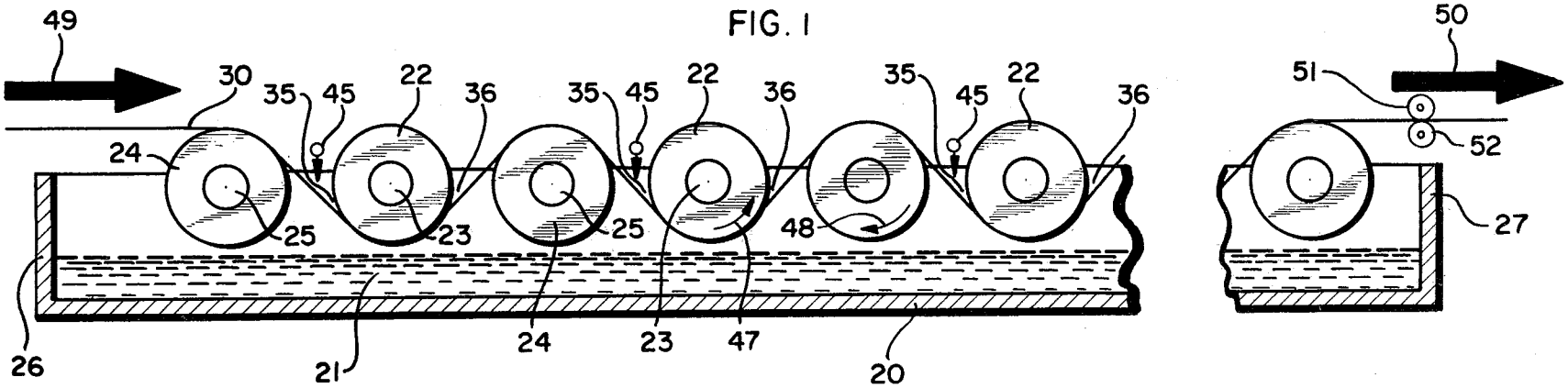
FIG. 1 is a schematic illustration of an embodiment of an apparatus in accordance with the present invention.
Figure 2:
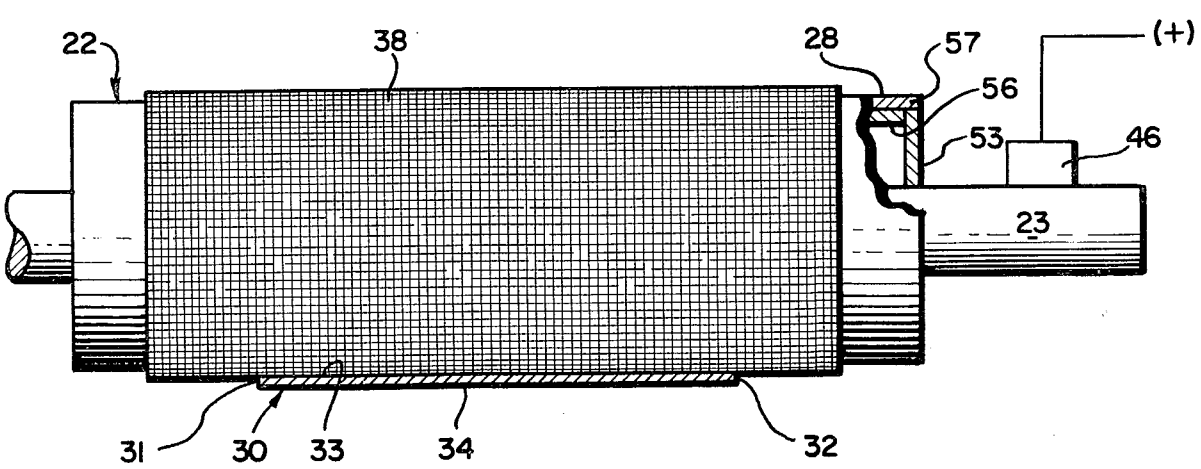
FIG. 2 is a side view, partially in section and partially cut away, illustrating one embodiment of an electrode roll in accordance with the present invention.

Referring initially to FIGS. 1–2, there is illustrated an embodiment of an apparatus in accordance with the present invention and comprising a tank 20 having upstream and downstream ends 26, 27, respectively, and containing a bath 21 of electrolytic liquid. Located above bath 21 are a plurality of cylindrical electrode rolls 22, 22 each having an outer surface 28 composed of electrically conductive material. Each cylindrical roll 22 comprises a shaft 23 which rotatably mounts cylinder 22 employing conventional bearing structure (not shown). Located between each pair of cylindrical rolls 22, 22, as well as at the upstream and downstream ends of tank 20 are a plurality of cylindrical contact rolls 24, 24 each having a shaft 25 and each rotatably mounted employing conventional bearing structure (not shown). Rolls 22, 22 and 24, 24 are electrically isolated from the rest of the apparatus in a conventional manner commonly employed in the electrotreating of metal strip.

Trained alternately over the top portion of a contact roll 24 and then under the bottom portion of an electrode roll 22 is a continuous metal strip 30 having a pair of side edges 31, 32, a top surface 33 and a bottom surface 34 (FIG. 2).

Figure 3:
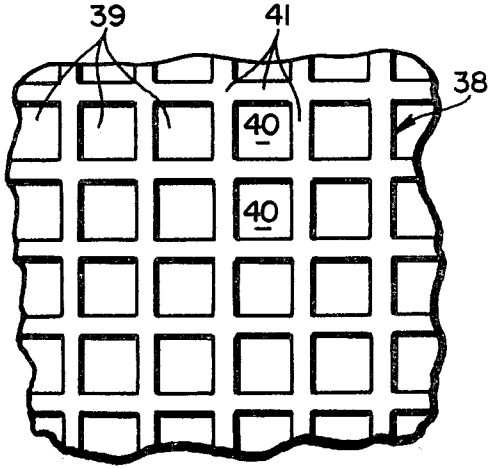
FIG. 3 is an enlarged, fragmentary side view of the electrode roll of FIG. 2.
Figure 4:
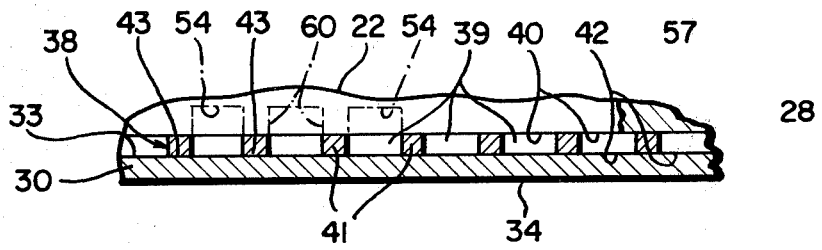
FIG. 4 is an enlarged, fragmentary side view, partially in section, illustrating the electrode roll of FIG. 2.

Covering the greater part of outer surface 28 of each electrode roll 22 and fixedly secured thereto is a porous mesh layer 38 (FIGS. 2–4) composed of electrically non-conductive material. In the embodiment of FIGS. 2–4, mesh layer 38 comprises intersecting strands 41, 41 with openings therebetween, and the strands are regularly spaced and disposed. Alternatively, the strands may be irregularly spaced and disposed.

Mesh layer 38 is interposed between and in contact with (a) the wrapped-around portion of each roll outer surface 28 and (b) one surface of metal strip 30, and the mesh layer comprises structure for preventing direct electrical contact between strip 30 and the anode roll's outer surface 28. Outer surface 28 and mesh layer 38 define a multiplicity of open-end electrotreating sites 39, 39 (FIG. 4), each having an inner base 40 defined by a part of roll outer surface 28, site-enclosing side walls 41, 41 defined by intersecting strands of mesh layer 38 and an open outer end 42 opposite base 40.

Training metal strip 30 alternately around contact rolls 24 and electrode rolls 22 in the manner illustrated in FIG. 1 causes a portion of continuous metal strip 30 to be wrapped around a substantial portion of each electrode roll 22, and this closes the sites 39, 39 on that portion of the electrode roll around which the continuous metal strip is wrapped (FIG. 4).

As shown in FIG. 1, wrapping metal strip 30 around electrode rolls 21, 22 in the manner described above also provides a pair of spaced-apart nips between strip 30 and each electrode roll, namely an upstream nip 35 at the location of initial upstream contact between strip 30 and roll 22 and a downstream nip 36 at the location of final downstream contact between strip 30 and roll 22.

Strip 30 is advanced in a downstream direction, as indicated by arrows 49, 50 in FIG. 1, by conventional driving structure such as driving rolls 51, 52 located at the downstream end of tank 20. Simultaneously with the advancement of metal strip 30 in a downstream direction, rolls 22, 24 are rotated at the same speed as strip 30 so as to avoid slippage between the rolls and the strip while maintaining the wrapped-around relationship between strip 30 and roll 22. In this connection, rolls 22, 24 may be idler rolls driven by the movement of strip 30 or they may themselves be driven by driving structure of a conventional nature (not shown). Rolls 22, 24 are rotated in the direction indicated by arrows 47, 48, respectively, in FIG. 1.

As strip 30 advances in a downstream direction and electrode rolls 22 rotate, the sites 39, 39 which were previously covered by strip 30 become uncovered, and sites 39, 39 on a portion of each electrode roll previously not wrapped by the strip become covered.

Electrolytic liquid is introduced into the sites 39, 39 on electrode roll 22 by directing liquid downwardly at upstream nip 35, through a nozzle 45 (FIG. 1). As strip 30 advances and roll 22 rotates in the direction of arrow 47, the electrolytic liquid introduced at upstream nip 35 floods the sites closed by the advancing strip. Excess liquid is squeezed out of sites 39, 39 at upstream nip 35 and accumulates at the nip, eventually spilling around strip side edges 31, 32 into tank 20.

Electrolytic liquid is held within a given site 39 closed by strip 30 for as long as strip 30 is in contact with that site, i.e., for the length of time it takes for the site to travel from an upstream nip 35 to a downstream nip 36. As strip 30 breaks contact with mesh layer 38 at a downstream nip 36, electrolytic liquid within a site 39 at the downstream nip is no longer trapped or prevented from escaping from the site. This liquid then drains out of the site as the site is rotated beyond downstream nip 36, away from strip 30, and the liquid drops into tank 20.

The outer surface 28 of roll 22 is provided with a charge having a first polarity, e.g., a positive charge if strip 30 is to be electroplated, and strip 30 is provided with a charge having a polarity opposite that of roll outer surface 28, e.g., a negative charge on strip 30 if the strip is to be electroplated. The electrical charge is applied to the outer surface 28 of roll 22 with conventional structure. For example, referring to FIG. 2, communicating with a source of electrical charge is a brush 46 in electrical contact with the roll's metal shaft 23 which is in electrical contact with a metal side plate 53 which is in electrical contact with a metal outer layer 57 having surface 28 as its outer surface.

An electrical charge is applied to strip 30 through contact rolls 24, 24 to which a charge is applied employing conventional structure which may be similar to that used with electrode roll 22.

Because strip 30 and electrode roll outer surface 28 have opposite charges, an electric current may flow between the two through the electrolytic liquid in flooded sites 39. In other words, referring to FIG. 4, at each closed site there is an electrolytic cell wherein that portion of electrode surface 28 defining site inner base 40 is one electrode, that portion of the adjacent strip surface closing the site is the other electrode and the electrolytic liquid within the closed site is the electrolytic bath.

In an electroplating operation, the electrolytic liquid contains cations of the metal to be plated, e.g., zinc cations. The flow of current between an electrode roll outer surface 28 and metal strip 30 causes cations to be deposited upon the adjacent surface of metal strip 30 (e.g., surface 33 in the Figs.). Zinc is applied to adjacent strip surface 33 as the strip moves from an upstream nip to a downstream nip on each electrode roll 22 in a sequence of rolls. The number of electrode rolls 22 which strip 30 contacts depends upon the thickness of the zinc coating to be applied to a given strip surface. Typically, there would be twenty to forty electrode rolls 22 in a given plating line.

Zinc is applied substantially only to that part of the strip surface which is in contact with the electrolytic liquid. More particularly, referring to FIG. 4, there are portions 43, 43 of strip surface 33 which are in contact with the site's side walls 41, 41 defined by the strands of mesh layer 38. Because these side walls are non-conductive, no zinc will be plated on those portions 43, 43 of strip surface 33 which are in contact with side walls 41, 41.

As noted above, metal strip 30 typically contacts twenty to forty different electrode rolls 22 in a plating line. The side walls 41, 41 defined by the mesh strands on any one such electrode roll are randomly oriented with respect to the side walls on the other electrode rolls in the plating line, so that side walls 41, 41 for a site 39 on any given electrode roll in the line are normally not aligned with the side walls for a site 39 on most, if not all, of the other electrode rolls in the line. In other words, the sites 39 on one roll 22 overlap with the sites 39 on another roll 22, for example. Accordingly, those portions 43, 43 on strip surface 33 which would be unplated at one given electrode roll 22 would not coincide with the portions 43, 43 which would be unplated at another given roll 22. Therefore, at the end of a sequence of twenty to forty electrode rolls 22, 22, all of the area on inner surface 33 of strip 30 will be plated and to essentially the same thickness.

Referring to FIG. 2, each roll 22 may be composed of two layers, an inner layer 56 composed of steel or copper, for strength, and an outer layer 57 composed of lead or zinc or graphite, for example. Inner layer 56 may be water cooled to offset the heat generated by electricity flowing therethrough.

Cations are depleted from the electrolytic liquid during the plating operation, and these cations may be replenished from outer layer 57 of the electrode rolls, if they are depletable anodes composed of zinc, or by other conventional expedients for replenishing cations if the outer layer is composed of lead or graphite.

The advantages of composing outer layer 57 of zinc are that it requires less power to perform the electroplating process than does a lead anode, and it generates less heat than does a lead anode so that the electrolytic liquid needs substantially less cooling. In addition, when outer layer 57 is composed of lead, the electrolytic liquid must be a zinc sulfate solution; however, when outer layer 85 is composed of zinc, the electrolytic liquid may be either a zinc sulfate solution or a zinc chloride solution. Zinc chloride solution is a better conductor than zinc sulfate solution, thereby decreasing the resistance and increasing the current density, in turn reducing power consumption for producing a given zinc coating thickness at a given rate. Zinc chloride solution cannot be used when outer layer 57 is composed of lead because a poorly conductive skin will form on the lead anode, and, in effect, kill the lead anode electrically. This skin has a high electrical resistance and increases power consumption. Zinc chloride solution can be used when outer layer 57 is composed of graphite.

Moreover, when outer layer 57 is composed of lead, the $H_2O$ in the dilute acid solution contained in the electrolytic liquid is broken down at the lead anode into hydroxyl ions plus oxygen gas, and the oxygen gas takes up space in the sites 39 which contain the electrolytic liquid. This reduces the amount of electrolytic liquid can be contained in a site, which is undesirable. This is not a problem, however, when employing a zinc anode and a zinc chloride solution.

When outer layer 57 of roll 22 is composed of zinc, the zinc may be provided as two semicircular pieces, or half shells, which are fixed to roll 22 with clamps (not shown), one located at each end of a roll. Each zinc anode half shell is rolled from a slab of electrolytic zinc. When the zinc anode is depleted, the two half shells are disassembled from the anode roll and remelted for casting into the slab from which an anode half shell is rolled.

The primary disadvantage which arises when outer layer 57 is composed of zinc is that the diameter of roll 22 decreases rather rapidly as plating occurs. For example, assuming an outer layer 57 composed of zinc ½ in. (12.7 mm) thick, with a roll 22 having a 3 ft. (0.91 m) diameter and travelling at a linear speed of 500 ft./min. (2.5 m/sec.) with a current density of 1,000 amps./ft.$^2$ (10,760 amps./m$^2$), the thickness of the zinc will be reduced by about ⅜ inch (9.5 mm) in ten hours for those areas on the anode roll's outer surface not covered by mesh strands 41, 41.

As previously indicated, strands 41, 41 are non-conductive. Because of this, those areas on the anode roll's outer surface 28 contacted by mesh strands 41, 41 will not be depleted during an electroplating operation at anywhere near the same rate as the areas on outer surface 28 not covered by strands 41, 41, and this leads to cratering on outer layer 57, as shown in dash-dot lines at 54 in FIG. 4.

If mesh layer 38 were not fixedly secured to outer surface 28, there would be some erosion of the areas on outer surface 28 covered by mesh strands 41, 41. This would result from a slight shifting of the strands due to stretching and the elastic nature of the strands. Therefore, not only would there be a relatively large reduction in the diameter of the anode roll's outer layer 57 at craters 54, but also there would be a smaller reduction in diameter at the ridges 60 around craters 54. The end result would be a loosening of mesh layer 38 relative to outer surface 28, whereas a tight fit is desired.

Moreover, after the craters have formed, a slight shifting movement on the part of a mesh strand causes part of the strand which was previously supported atop a crater ridge 60 to become unsupported; and the remainder of the supported mesh strand is subjected to increased pressure by the metal strip bearing against it. This prematurely crushes or mutilates the mesh strand and requires more frequent replacement of the mesh layer than would be the case if the mesh strands weren't prematurely crushed in that manner.

To avoid the above-described drawbacks resulting when mesh layer 38 is not fixedly securd to the anode roll's outer surface 28, the mesh layer is fixedly secured to outer surface 28 in accordance with the present invention. This maintains the outside diameter of roll 22 (except for the craters) at its initial diameter substantially throughout the electroplating operation. As a result, the desirable tight fit of mesh layer 38 relative to the anode roll's outer layer 28 is maintained. Moreover, because the strands 41 are fixedly secured to outer surface 28, a slight shifting movement on the part of a given strand is substantially prevented, thereby preventing the strand from being prematurely mutilated.

Eventually, the crater ridge 60 on which a strand 41 is fixedly secured, will be eroded along its sides, from the inside of the crater. In time, erosion from inside the crater will dissolve the ridge, but this will not occur until substantially well into the electroplating operation.

The embodiment of mesh layer 38 illustrated in FIGS. 2–4 may be adhesively secured to the anode roll's outer surface 28 or it may be integrally bonded thereto, e.g., by silk screening or molding.

Examples of material which may be employed as the mesh layer when the latter is adhesively secured to outer surface 28 of the anode roll are polyethylene and polypropylene. The adhesive preparation for adhesively securing a porous mesh layer composed of either of these materials comprises a suspension of the material in a solvent solution such as methylcellosolve acetate. The suspension is applied to a surface of the mesh layer, that surface is laid on the anode roll's outer surface 28, and the assembly is heated to about 400° F. (204° C.) for about 15 minutes.

Other materials of which the mesh layer may be composed when a porous mesh layer is adhesively secured to the anode roll's outer surface 28 include polyvinylchloride, polyvinyldichloride, and the family of urethanes of various molecular weights and densities.

When the mesh layer is composed of polyvinylchloride or polyvinyldichloride, it may be fixedly secured to outer surface 28 by temporarily securing the mesh layer around surface 28 and then heating the assembly at conventional temperatures and time periods employed for the thermal bonding of polyvinylchloride or polyvinyldichloride to metallic surfaces. The end result is a mesh layer composed of polyvinylchloride or polyvinyldichloride fixedly secured to outer surface 28 by thermal bonding.

A porous mesh layer composed of urethane may be fixedly secured to the outer surface of the anode roll employing conventional adhesives for adhering a urethane material to a metal surface.

When the mesh layer is to be silk screened or "printed" on outer surface 28, the mesh layer may be composed of a urethane material suspended in a conventional solvent for the urethane. The suspension is applied to outer surface 28 employing conventional silk screening or printing techniques utilizing a screen or template having the desired pattern or configuration. After the urethane suspension has been applied to the outer surface of the electrode roll, it is subjected to a curing step at a temperature above 600° F. (316° C.), to drive off the solvent, leaving an integrally-bonded porous mesh layer composed of urethane.

Mesh layer 38 may also be fixedly secured to the outer surface of the electrode roll by applying an unperforated layer of mesh material to outer surface 28 of the anode roll and then removing, from the unperforated layer of mesh material, material that corresponds to the perforated part of the mesh. The layer of mesh material may be composed of any of the plastic materials described above, and may be adhered or bonded to the outer surface of the electrode roll in any of the manners described above.

Figure 5:
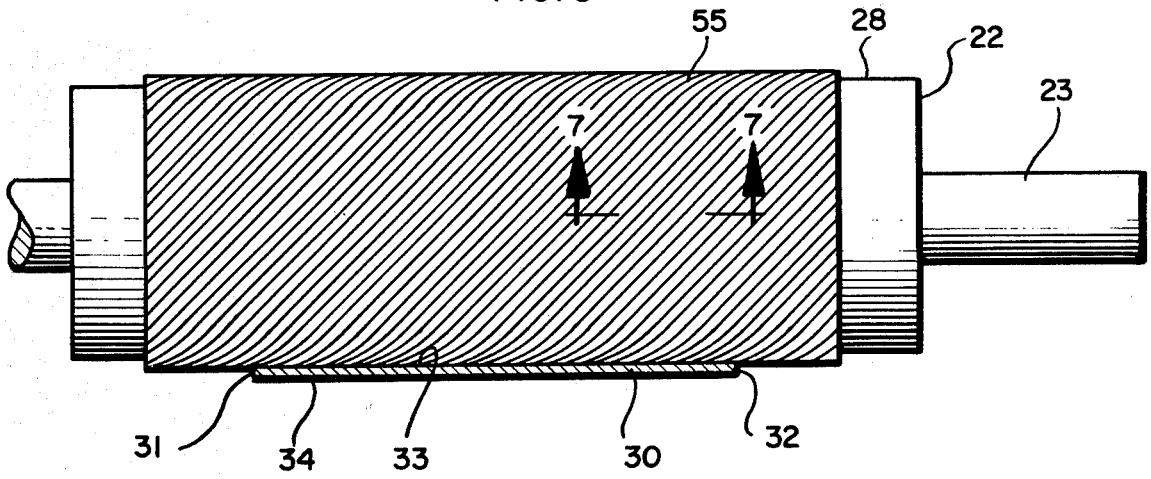
FIG. 5 is a side view illustrating another embodiment of an electrode roll in accordance with the present invention.
Figure 6:
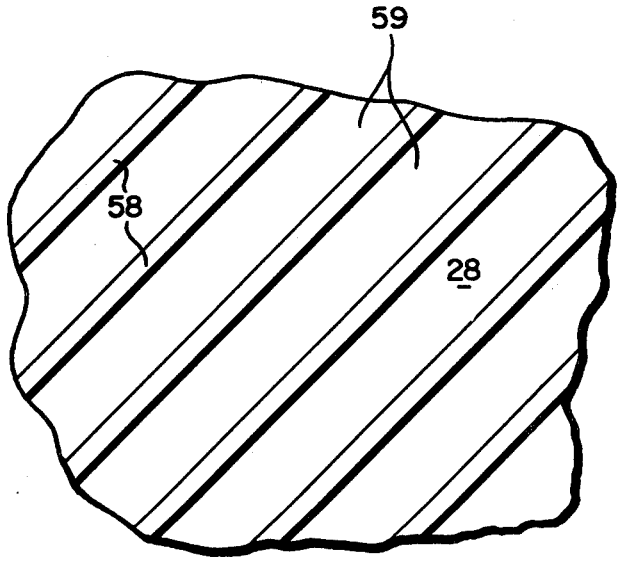
FIG. 6 is an enlarged, fragmentary side view illustrating the mesh layer on the electrode roll of FIG. 5.
Figure 7:
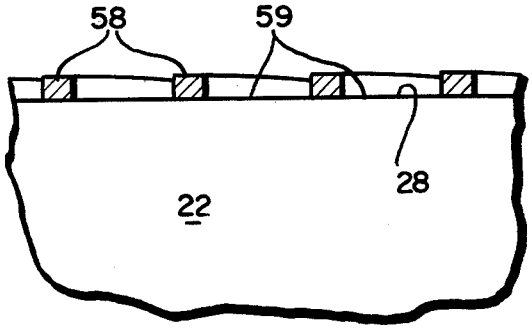
FIG. 7 is an enlarged, sectional view taken along line 7—7 in FIG. 5.

Another example of a mesh layer integrally bonded to the anode roll's outer surface 28 is illustrated in FIGS. 5–7. In this embodiment, the outer layer 55 of mesh material is composed of a moldable plastic, such as polyurethane which is poured as a liquid into a mold located around the anode roll's outer surface 28 and cured. Alternatively, polyurethane layer 55 may be bonded to outer surface 28 employing any conventional procedure for bonding a polyurethane layer to a metal surface. After the layer of polyurethane has been bonded to outer surface 28, a continuous spiral site or cell is machined in layer 55 employing a lathe. This results in a multiplicity of alternate spiral ridges 58 and grooves 59. The bottom of each groove is defined by outer surface 28 of anode roll 22.

Other plastic materials which may be employed to produce a mesh layer into which spiral grooves and ridges are machined, as in the embodiment of FIGS. 5–7, include polyvinylchoride or polyvinyldichloride. A sheet of either of these plastic materials is thermally bonded to the electrode roll's outer surface, following which the spiral ridges and grooves are machined in the plastic material employing the machining technique described above.

Similarly, a sheet of polyethylene or polypropylene may be adhesively secured to the outer surface of the electrode roll, employing adhesive compositions and procedures of the type described above. The sheet of plastic material is then subjected to the machining operation described above.

As noted above, mesh layers 38 and 55 are composed of a material which is non-conductive electrically. In addition, the mesh layer should be sufficiently inelastic to resist significant deformation due to strip torque, so that the mesh won't become distorted on the roll. The mesh layer should not bend or twist relative to itself, and should remain parallel with the cylindrical outer surface 28 of roll 22.

The mesh layer should be relatively chemically inert to and insoluble in the electrolytic liquid. The material of which the mesh layer is composed must be capable of retaining its properties at temperatures above about 120° F. (49° C.) up to about 212° F. (100° C.). Typicaly, the mesh layer will be exposed to average temperatures in the range 120°–150° F. (49°–66° C.) although localized temperatures can go up to 180° F. (82° C.), for example.

The distance between the centers of opposed side walls 41, 41 of mesh layer 38 or ridges 58, 58 of mesh layer 55 should be sufficiently small to prevent the steel strip in contact with the mesh layer from sagging down and touching outer surface 28 on roll 22. For example, the distance from the center of one side wall 41 (or ridge 58) to the center of the opposed side wall 41 (or ridge 58) may be in the range 0.09–1.0 in. (2.3–25.4 mm), e.g., 0.38 in. (9.7 mm).

The width of length of mesh opening 38 or the width of groove 59 may be in the range 0.06 to 0.91 in. (1.52 to 23.1 mm), a typical width being about ¼ in. (6.4 mm). The side walls 41, 41 or ridges 58, 58 may have a width in the range 0.03 to 0.09 in. (0.76 to 2.29 mm), a typical width being about 1/16 in. (1.6 mm).

The depth of mesh layer 38 or 55 may be in the range 0.01 to 0.08 in. (0.25 to 2.0 mm), and a mesh layer depth of 0.06 in. (1.5 mm) would be typical.

The foregoing detailed description has been given for clearness of understanding only, and no unnecessary limitations should be understood therefrom, as modifications will be obvious to those skilled in the art.

What is claimed is:

1. In an apparatus for conducting an electrotreating operation on a continuous metal strip:

a cylindrical electrode roll composed of electrically conductive material and having an outer surface;

said electrode roll having an initial outside diameter;

means for wrapping a portion of a continuous metal strip around a portion of said electrode roll;

a porous mesh layer, composed of non-conductive material, disposed around said outer surface of the electrode roll;

said mesh layer comprising means for maintaining said wrapped-around portion of the metal strip in non-contacting, spaced relation to said outer surface of the electrode roll;

means for introducing an electrolytic liquid into the space between said metal strip and said outer surface of the electrode roll;

said porous mesh layer comprising means for maintaining said electrolytic liquid in said space while said strip portion is wrapped around said portion of the electrode roll;

said last recited means comprising means on said porous mesh layer defining, on the outer surface of the electrode roll, a plurality of open sites separated by side walls;

the width of said side walls being relatively small compared to the width of said open site;

and means fixedly securing said mesh layer to said outer surface for maintaining the outside diameter of said electrode roll at said initial diameter substantially throughout said electrotreating operation.

2. In an apparatus as recited in claim 1 and for conducting an electroplating operation, wherein:

said electrode roll comprises a depletable anode roll having an outer layer composed of the plating metal.

3. In an apparatus as recited in claim 1 wherein:

said porous mesh layer is adhesively secured to said outer surface of the electrode roll.

4. In an apparatus as recited in claim 1 wherein:

said porous mesh layer is integrally bonded to said outer surface of the electrode roll.

5. In an apparatus as recited in claim 1 wherein:

said porous mesh layer comprises a multiplicity of alternate spiral ridges and grooves;

the bottom of said grooves being defined by said outer surface of the electrode roll.

6. In an apparatus as recited in claim 1 wherein;

said porous mesh layer comprises intersecting strands.

7. In an apparatus for conducting an electrotreating operation on a continuous metal strip:

a cylindrical electrode roll composed of electrically conductive material and having an outer surface;

said electrode roll having an initial outside diameter;

a porous mesh layer, composed of non-conductive material, disposed around said outer surface of the electrode roll;

said porous mesh layer comprising means defining, on the outer surface of the electrode roll, a plurality of open electrotreating sites separated by side walls;

the width of said side walls being relatively small compared to the width of said open site;

and means fixedly securing said mesh layer to said outer surface for maintaining the outside diameter of said electrode roll at said initial diameter substantially throughout said electrotreating operation.

* * * * *